US005831251A

United States Patent [19]

Oya et al.

[11] Patent Number: 5,831,251

[45] Date of Patent: Nov. 3, 1998

[54] HEATER UNIT HAVING INCREASED DIELECTRIC STRENGTH

[75] Inventors: Yasuhiro Oya, Nagoya; Keiichi Yamada, Toyoake; Yosinori Akiyama; Yasuaki Tsujimura, both of Okazaki, all of Japan

[73] Assignee: Denso Corporation, Kariya, Japan

[21] Appl. No.: 794,992

[22] Filed: Feb. 5, 1997

[30] Foreign Application Priority Data

Feb. 6, 1996 [JP] Japan ..... 8-045437

[51] Int. Cl.[6] ..... H05B 1/02

[52] U.S. Cl. ..... 219/504; 219/505; 219/539; 219/544; 338/319; 338/22 R

[58] Field of Search ..... 219/504, 505, 219/520, 522, 538, 539, 544, 535; 338/22 R, 329, 318, 319

[56] References Cited

U.S. PATENT DOCUMENTS

| | | | |
|---|---|---|---|
| 4,104,509 | 8/1978 | Van Bokestal et al. | 219/544 |
| 4,814,584 | 3/1989 | Bohlender et al. | 219/535 |
| 4,841,127 | 6/1989 | Prager et al. | 219/225 |
| 4,855,570 | 8/1989 | Wang | 219/539 |
| 4,939,349 | 7/1990 | Liu | 219/552 |
| 5,059,767 | 10/1991 | Marks et al. | 219/209 |

FOREIGN PATENT DOCUMENTS

| | | |
|---|---|---|
| 63-38556 | 10/1988 | Japan . |
| 6-045054 | 2/1994 | Japan . |
| 7-014664 | 1/1995 | Japan . |

*Primary Examiner*—Mark H. Paschall
*Attorney, Agent, or Firm*—Cushman Darby & Cushman IP Group of Pillsbury Madison & Sutro LLP

[57] ABSTRACT

A heater unit 1 has a plurality of flat heaters 11 adjacently arranged side by side and having common upper and lower surfaces. The thickness T of the heaters 11 is substantially uniform. Each heater 11 has an adjacent end surface 111 which faces toward an adjacent end surface 111 of the adjacent heater 11. The heater unit 1 also has upper and lower electrodes 21 holding the heaters 11 and respectively attached to the upper and lower surfaces of the heaters 11. The adjacent end surfaces 111 of the heaters 11 adjoining each other, and the upper and lower electrodes 21 form an air gap 12 therebetween. The creepage distance L along each adjacent end surface 111 is larger than the thickness T of the heaters 11. The dielectric strength of the heater unit 1 depends on the creepage distance L. The thickness T of the heaters 11 can be decreased without decreasing the dielectric strength of the heater unit 1. The output of the heater unit 1 increases when the thickness T is decreased.

10 Claims, 5 Drawing Sheets

HEATER UNIT HAVING INCREASED DIELECTRIC STRENGTH

BACKGROUND OF THE INVENTION

1. Field of the Invention

The present invention relates to a heater unit having heaters held by electrodes, and in particular to a heater unit having great dielectric strength.

2. Description of the Related Art

As in known in the prior art, a heater unit 90 has flat positive temperature coefficient (PTC) thermistor elements 91, and positive and negative electrodes 921 and 922 holding the thermistor elements 91 between the electrodes 921 and 922, the electrodes 921 and 922 being integrally formed with outer radiating fins 93 respectively, as shown in FIG. 8. Such a heater unit is disclosed in Unexamined Patent Publication (Kokai) No. 6-45054, for example. In general, the heater unit 90 has a plurality of thermistor elements 91 in order to increase its amount of heat. Each thermistor element 91 has an adjacent end surface 911 which is a flat surface perpendicular to the electrodes 921 and 922. Reference numeral 94 denotes a terminal plate via which voltage is applied to the heater unit 90.

As the thermistor element 91 is formed of ceramic, the thermal conductivity of the thermistor element 91 is low, so that the thermistor element 91 has temperature gradient from the center of the thermistor element 91 toward the surfaces of the electrodes 921 and 922. When the thickness T of the thermistor element 91 is decreased, the difference in temperature between the inside and the outside of the thermistor element 91 becomes small, and the amount of heat of the heater unit 90 increases. FIG. 9 shows the relation between the thickness T of the thermistor element 91 and the thermal output ratio. For example, the thermal output ratio is 1 when the thickness T of the thermistor element 91 is 2.5 mm, and the thermal output ratio is more than 1.3 when the thickness T of the thermistor element 91 is 1.5 mm.

The heater unit 90 can be used, for example, in a hot-air heater, a clothing dryer, a quilt dryer, a dish dryer, a dryer such as a hand dryer, an intake air heater of an automobile, and an automobile interior heater. Such commercial items must follow the standards regulated under the Electric Equipment Regulatory Law.

The thermistor element used in the heater unit has to be a heater having great dielectric strength. The heater can be a ceramic heater, including a thermistor element made of vanadium oxide or barium titanate, for example. Also, the heater can be a resin form heater including a conductive material, instead of a heater including the thermistor element.

As described above, when the thickness T of the thermistor element 91 is decreased, the output of the heater unit 90 increases. However, when the thickness T of the thermistor element 91 is decreased, the insulating distance T between the electrodes 921 and 922 is decreased, so that the dielectric strength of the heater unit 90 decreases. Also, when the thickness T of the thermistor element 91 is decreased, the heater unit 90 cannot secure the spatial separation regulated under the Electric Equipment Regulatory Law.

When a heater unit (not shown) which has only one thermistor element is used, as the dielectric strength of the thermistor element is much larger than the dielectric strength of the air, the dielectric strength of the heater unit is substantially the dielectric strength of the air. Therefore, the dielectric strength of the heater unit depends on the creepage distance along the outer surface of the thermistor element between the electrodes in the atmosphere.

Japanese Unexamined Utility Model Publication (Kokai) No. 63-38556 shows a thermistor element 91, an outer edge 915 of the thermistor element 91 laterally projecting beyond the edges of the electrodes 921 and 922, in order to increase the creepage distance (=A1+T+A2) along the outer surface of the thermistor element 91 between the electrodes 921 and 922 in the atmosphere, as shown in FIG. 8.

However, as shown in FIG. 8, when a heater unit 90 which has a plurality of thermistor elements 91 is used, the heater unit 90 has at least an air gap 912 between adjacent end surfaces 911 of the thermistor elements 91 which adjoin each other. Also, the dielectric strength of the heater unit 90 does not depend on the creepage distance (=A1+T+A2) along the outer surface of the thermistor element 91 between the electrodes 921 and 922 in the atmosphere, but the creepage distance T along the adjacent end surface 911 of the thermistor element 91 in the air gap 912 between the electrodes 921 and 922. Namely, the dielectric strength decreases when the thickness T of the thermistor element 91 is decreased, even if the outer edges 915 of the thermistor elements 91 laterally project beyond the edges of the electrodes 921 and 922.

Japanese Unexamined Patent Publication (Kokai) No. 7-14664 shows a heater unit having insulating members interposed into air gaps between the thermistor elements adjoining each other. However, it is not easy to interpose the thin insulating member into the narrow air gap between the adjacent end surfaces of the thermistor elements. Also, the insulating material may come out of the air gap when the insulating members are assembled.

SUMMARY OF THE INVENTION

An object of the present invention is to provide a heater unit having a simple structure, great dielectric strength, and high heating efficiency.

The present invention provides a heater unit comprising:

a plurality of flat heaters adjacently arranged side by side and having opposite surfaces, the thickness of the heaters between the opposite surfaces being substantially uniform, each heater having an adjacent end surface which faces toward an adjacent end surface of the adjacent heater;

upper and lower electrodes holding the heaters between the upper and lower electrodes and respectively attached to the opposite surfaces of the heaters;

the adjacent end surface of the adjacent heater, and the upper and lower electrodes forming an air gap therebetween; and the creepage distance along each adjacent end surface in the air gap between the upper and lower electrodes being larger than the thickness of the heaters.

The dielectric strength depends on the creepage distance along the adjacent end surface in the air gap between the upper and lower electrodes, the creepage distance being larger than the thickness of the heaters. The thickness of the heaters can be decreased without decreasing the dielectric strength of the heater unit. The output of the heater unit increases when the thickness of the heaters is decreased.

Preferably, some of the heaters arranged outermostly in the heater unit may have outer edge surfaces facing toward the atmosphere and laterally projecting beyond the electrodes, so that the creepage distance along the outer edge surface in the atmosphere is larger than the thickness of the heaters, and than the creepage distance along the adjacent end surface in the air gap between the upper and lower electrodes.

Further, when the adjacent end surface of the heater is bent, the creepage distance along the adjacent end surface increases.

Furthermore, when the distance between adjacent end surfaces of the heaters adjoining each other is wider in at least a part of the air gap, and the air gap receives an insulating member, the dielectric strength of the heater unit increases.

In a further embodiment, the electrodes may be integrally formed with radiating fins, so that the heat produced by the heaters can discharge effectively.

In a still further embodiment, the heaters may be made of positive temperature coefficient (PTC) thermistor elements, the value of resistance of the thermistor elements increasing when the temperature of the thermistor elements increases, so that the heating temperature of the heater unit can be kept constant even if the temperature of the atmosphere or the supply voltage changes.

BRIEF DESCRIPTION OF THE DRAWINGS

The above and other objects, features and advantages of the present invention will be made more apparent from the ensuring description of the preferred embodiments thereof in conjunction with the accompanying drawings wherein.

DESCRIPTION OF THE PREFERRED EMBODIMENTS

Figure 1:
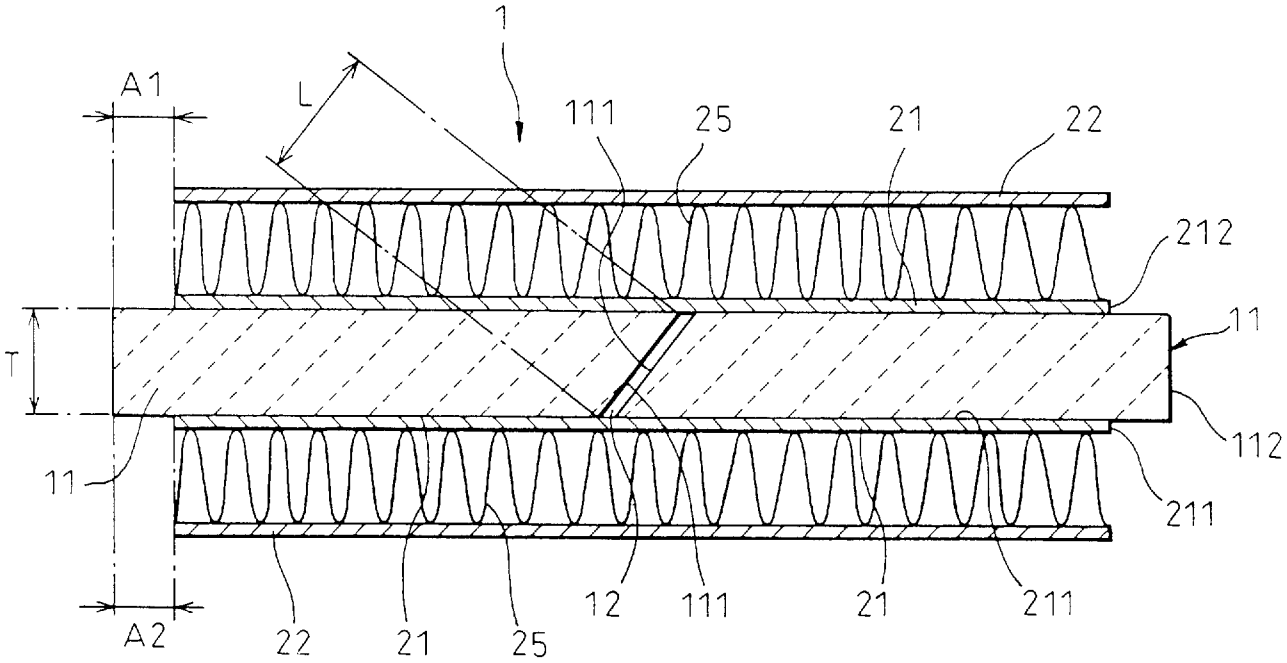
FIG. 1 is a cross-sectional view of a heater unit according to an embodiment of the present invention.

FIG. 1 shows a heater unit 1 according to an embodiment of the present invention. As shown in FIG. 1, the heater unit 1 has a plurality of flat heaters, the heater being a positive temperature coefficient (PTC) thermistor element 11. The thermistor elements 11 are adjacently arranged side by side and have common upper and lower surfaces. The heater unit 1 also has upper and lower electrodes 21 holding the PTC thermistor elements 11 therebetween and respectively attached to the upper and lower surfaces of the PTC thermistor elements 11. The upper and lower electrodes 21 apply voltage to the PTC thermistor elements 11. The thickness T of the PTC thermistor elements 11 between the upper and lower surfaces is substantially uniform.

Each PTC thermistor element 11 has an adjacent end surface 111 which faces toward an adjacent end surface 111 of the adjacent PTC thermistor element 11. The adjacent end surface 111 is not perpendicular but, for example, is inclined, to the upper or lower surface of the PTC thermistor element 11. The adjacent end surfaces 111 of the PTC thermistor elements 11 and the upper and lower electrodes 21 form an air gap 12 therebetween. The creepage distance L along the adjacent end surface 111 in the air gap 12 between the upper and lower electrodes 21 is larger than the thickness T of the PTC thermistor elements 11. In other words, a length of air gap 12 between upper and lower electrodes 21 is greater than the perpendicular distance between the upper and lower electrodes 21.

The PTC thermistor element 11 has an outer edge surface 112 facing toward the atmosphere and laterally projecting beyond the outer edge surfaces 212 of the electrodes 21.

The upper and lower electrodes 21 are integrally formed with radiating fins 25, respectively. Namely, the radiating fins 25 are brazed to the electrodes 21. Further, upper and lower terminal plates 22 are respectively brazed to the radiating fins 25 on the opposite side of the radiating fins 25 from each electrode 21. The terminal plates 22 are connected with terminals of an electric power supply, not shown.

The upper and lower electrodes 21 are adhered to the PTC thermistor elements 11 by adhesive material. The upper and lower electrodes 21 may be mechanically connected with the PTC thermistor elements 11 by elastic members instead of the adhesive material, so that the upper and lower electrodes 21 and the PTC thermistor elements 11 are pressed and electrically conductible.

As described above, each PTC thermistor element 11 has an adjacent end surface 111 which faces toward the adjacent end surface 111 of the adjacent PTC thermistor element 11. The adjacent end surface 111 is not perpendicular to the upper or lower surface of the PTC thermistor element 11. The adjacent end surfaces 111 of the PTC thermistor elements 11, and the upper and lower electrodes 21 form the air gap 12 therebetween. The creepage distance L along the adjacent end surface 111 in the air gap 12 between the upper and lower electrodes 21 is larger than the thickness T of the PTC thermistor elements 11. Thus, the dielectric strength of the heater unit 1 does not depend on the thickness T of the PTC thermistor elements 11, but on the creepage distance L along the adjacent end surface 111 in the air gap 12 between the upper and lower electrodes 21. Therefore, the thickness T of the heaters can be decreased without decreasing the dielectric strength of the heater unit 1.

Further, as described above, the thermistor element 11 has an outer edge surface 112 facing toward the atmosphere and laterally projecting beyond the outer edge surfaces 212 of the electrodes 21. So that, the creepage distance (=A1+T+A2) between the outer edge surfaces 212 of the electrodes 21 in the atmosphere is larger than the thickness T of the PTC thermistor elements 11. The thickness T of the PTC thermistor elements 11 can be decreased without decreasing the dielectric strength of the heater unit 1, in the area of the outer edge surfaces 212 of the electrodes 21. The output of the heater unit 1 increases when the thickness T of the PTC thermistor elements 11 is decreased.

Figure 2:
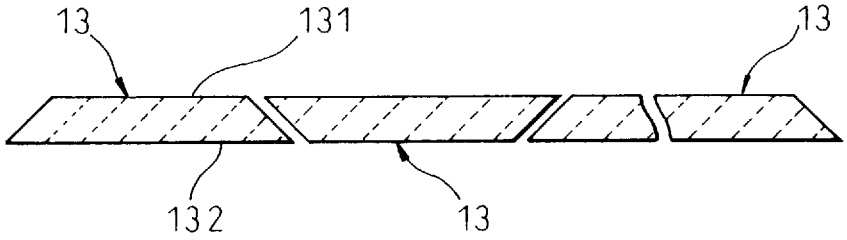
FIG. 2 is a cross-sectional view of a heater unit according to another embodiment of the present invention, showing only the thermistor elements thereof.

FIG. 2 shows a heater unit according to another embodiment of the present invention, showing only PTC thermistor elements 13 thereof. As shown in FIG. 2, three or more than three PTC thermistor elements 13 are adjacently arranged side by side, each PTC thermistor element 13 having the same trapezoid section. The PTC thermistor elements alternatingly face opposite directions. Namely, the short side 131 of the left PTC thermistor element 13 is arranged on an upper side, and the long side 132 of the middle PTC thermistor element 13 is arranged on the upper side, and again the short side 131 of the right PTC thermistor element 13 is arranged on the upper side, so that, air gaps between the PTC thermistor elements 13 are small. Further, the creepage distance is larger than the thickness of the PTC thermistor elements 13. The thickness of the PTC thermistor elements 13 can be decreased without decreasing the dielectric strength of the heater unit. The output of the heater unit increases when the thickness of the PTC thermistor elements 13 is decreased.

Figure 3:
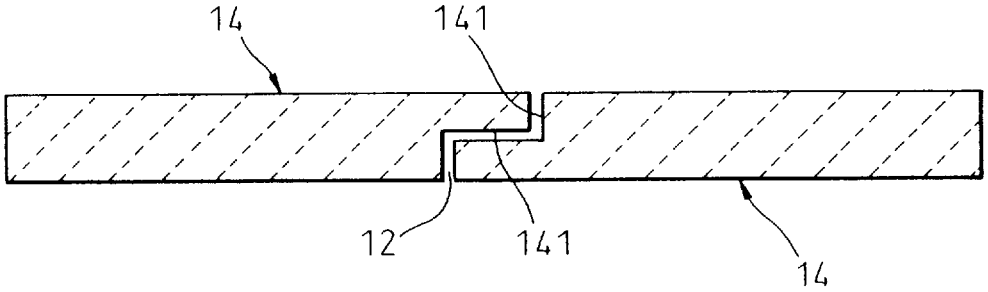
FIG. 3 is a cross-sectional view of a heater unit according to another embodiment of the present invention, showing only the thermistor elements thereof.

FIG. 3 shows a heater unit according to another embodiment of the present invention, showing only PTC thermistor elements 14 thereof. As shown in FIG. 3, adjacent end surfaces 141 of the PTC thermistor elements 14 are bent, so that, the creepage distance along the bent adjacent end surface 141 is larger than the creepage distance along the inclined adjacent end surface, as shown in FIGS. 2 and 3, and is larger than the thickness of the PTC thermistor elements. Further, the thickness of the PTC thermistor elements 14 can be decreased without decreasing the dielectric strength of the heater unit. The output of the heater unit increases when the thickness of the PTC thermistor elements 14 is decreased.

Figure 4:
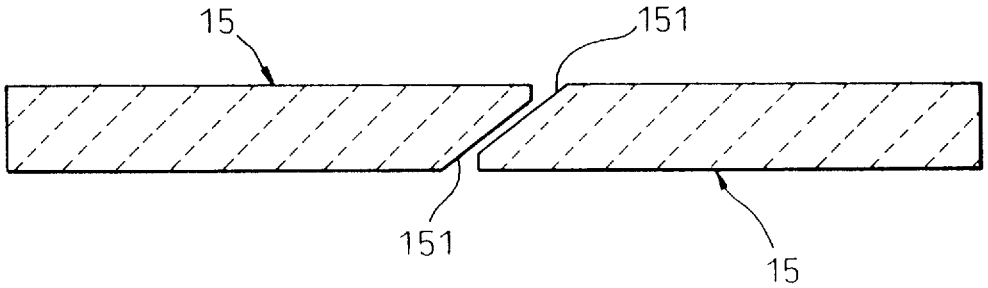
FIG. 4 is a cross-sectional view of a heater unit according to another embodiment of the present invention, showing only the thermistor elements thereof.

FIG. 4 shows a heater unit according to another embodiment of the present invention, showing only PTC thermistor elements 15 thereof. As shown in FIG. 4, an inclined adjacent end surface 151 of the PTC thermistor element 15 has a step portion, so that, it is easy to mold the PTC thermistor elements 15 and the PTC thermistor elements 15 can be strong. Further, the creepage distance is larger than the thickness of the PTC thermistor elements 15. The thickness of the PTC thermistor elements 15 can be decreased without decreasing the dielectric strength of the heater unit. The output of the heater unit increases when the thickness of the PTC thermistor elements 15 is decreased.

Figure 5:
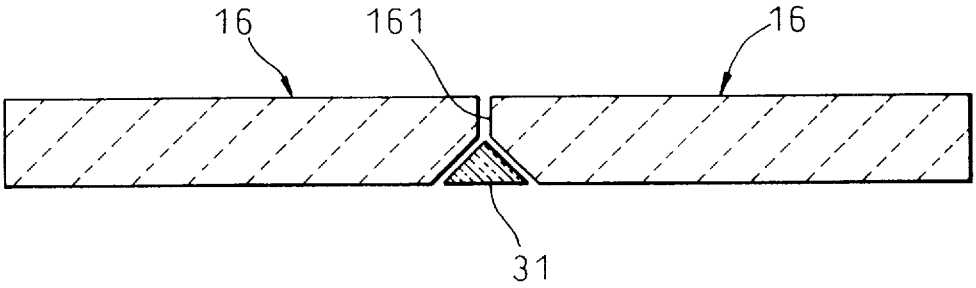
FIG. 5 is a cross-sectional view of a heater unit according to another embodiment of the present invention, showing only the thermistor elements and an insulating member thereof.
Figure 6:
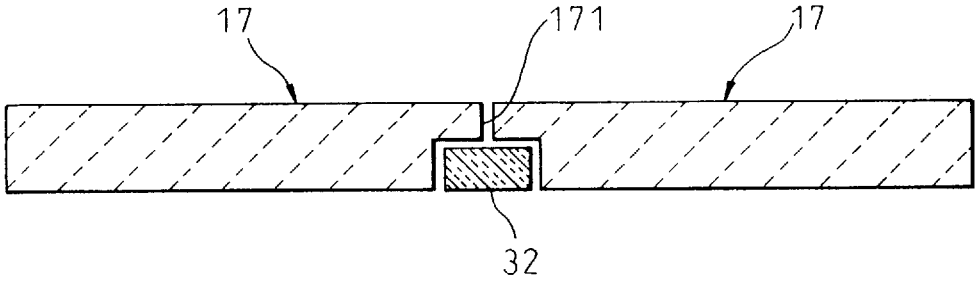
FIG. 6 is a cross-sectional view of a heater unit according to another embodiment of the present invention, showing only the thermistor elements and an insulating member thereof.
Figure 7:
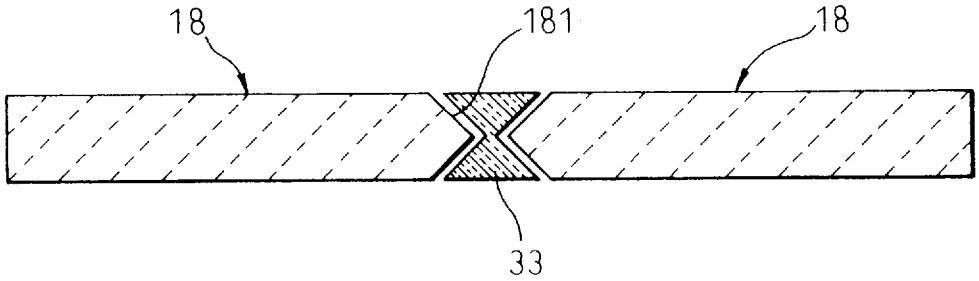
FIG. 7 is a cross-sectional view of a heater unit according to another embodiment of the present invention, showing only the thermistor elements and an insulating member thereof.
Figure 8:
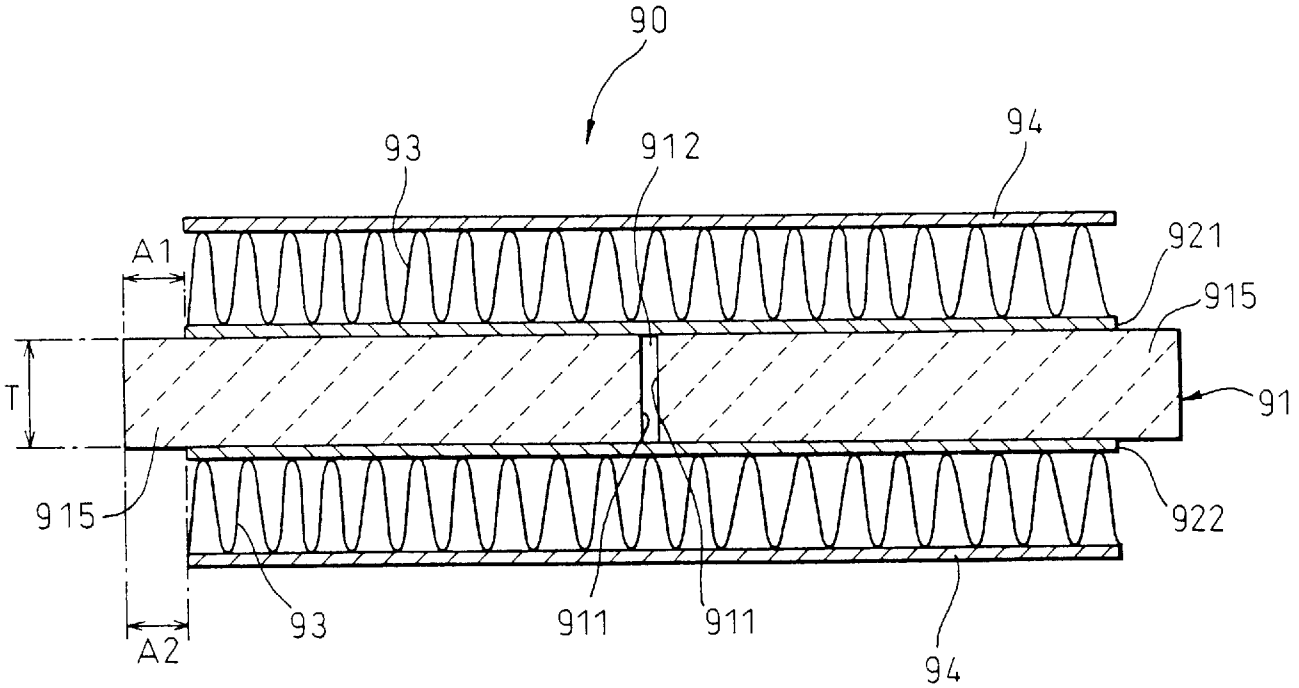
Fig.8 PRIOR ART
FIG. 8 is a cross-sectional view of a heater unit of the prior art.
Figure 9:
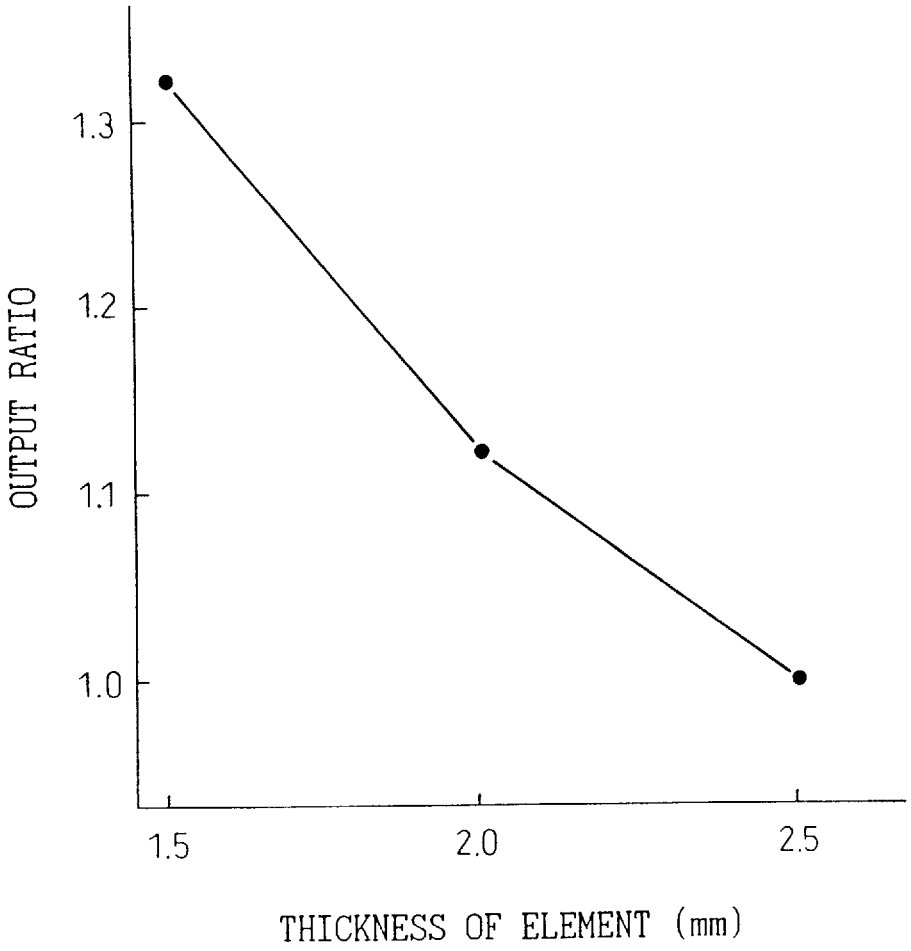
FIG. 9 is a graph showing the relation between the thickness of the thermistor element and the thermal output ratio.

FIGS. 5 to 7 show heater units according to other embodiments of the present invention, showing only the thermistor elements and insulating members thereof. As shown in FIGS. 5 to 7, the distance between adjacent end surfaces 161, 171 or 181 of the PTC thermistor elements 16, 17 or 18 adjoining each other is wider in at least a part of the air gap. The air gap receives an insulating member 31, 32 or 33 between the adjacent end surfaces 161, 171 or 181, so that, the dielectric strength of the heater unit increases. Further, the creepage distance is larger than the thickness of the PTC thermistor elements 16, 17 or 18. The thickness of the PTC thermistor elements 16, 17, or 18 can be decreased without decreasing the dielectric strength of the heater unit. The output of the heater unit increases when the thickness of the PTC thermistor elements 16, 17 or 18 is decreased.

While the above description constitutes the preferred embodiment of the present invention, it will be appreciated that the invention is susceptible to modification, variation and change without departing from the proper scope and fair meaning of the accompanying claims.

What is claimed is:

1. A heater unit comprising:

two substantially parallel electrodes, each electrode having a flat surface; and a plurality of flat heaters adjacently arranged side by side and held between the flat surfaces of the electrodes, wherein adjacent flat heaters define an air gap therebetween which extends between the flat surfaces of the electrodes such that a length of the air gap between the flat surfaces of the electrodes is greater than the perpendicular distance between the flat surfaces of the electrodes.

2. A heater unit according to claim 1, wherein some of the heaters arranged outermostly in the heater unit have outer edge surfaces facing toward the atmosphere and laterally projecting beyond the electrodes.

3. A heater unit according to claim 1, wherein each heater has a bent adjacent end surface which faces a bent adjacent end surface of another adjacent heater.

4. A heater unit according to claim 2, wherein each heater has a bent adjacent end surface which faces a bent adjacent end surface of another adjacent heater.

5. A heater unit according to claim 1, wherein the air gap receives an insulating member.

6. A heater unit according to claim 2, wherein the air gap receives an insulating member.

7. A heater unit according to claim 3, wherein the air gap receives an insulating member.

8. A heater unit according to claim 4, wherein the air gap receives an insulating member.

9. A heater unit according to claim 1, wherein the electrode is integrally formed with radiating fins.

10. A heater unit according to claim 1, wherein the heater is a positive temperature coefficient thermistor element.

* * * * *